US005186374A

United States Patent [19]

Buxton

[11] Patent Number: 5,186,374

[45] Date of Patent: Feb. 16, 1993

[54] BALL HOLDER

[76] Inventor: Pierce Buxton, 1801 Gough St., #201, San Francisco, Calif. 94109

[21] Appl. No.: 750,895

[22] Filed: Aug. 23, 1991

[51] Int. Cl.[5] ..... A45F 5/00

[52] U.S. Cl. ..... 224/191; 224/226; 224/235; 224/253; 224/919; 273/32 D

[58] Field of Search ..... 224/191, 226, 236, 235, 224/251, 253, 919, 918; 206/315.9; 273/32 D; 383/66, 87, 44

[56] References Cited

U.S. PATENT DOCUMENTS

| | | | |
|---|---|---|---|
| 1,778,225 | 10/1930 | Morss | 224/919 X |
| 2,508,190 | 5/1950 | Previdi | 224/919 X |
| 3,968,522 | 7/1976 | Riess | 224/919 X |
| 4,082,209 | 4/1978 | Sanders | 224/919 X |
| 4,678,108 | 7/1987 | Inman | 224/919 X |
| 4,798,319 | 1/1989 | James | 224/919 X |
| 4,840,332 | 6/1989 | Hoyt | 224/251 X |
| 4,917,282 | 4/1990 | Hufford | 224/919 X |
| 4,928,819 | 5/1990 | Jakobsen | 224/908 X |
| 5,031,812 | 7/1991 | Gustine | 224/919 X |

FOREIGN PATENT DOCUMENTS

| | | | |
|---|---|---|---|
| 1294937 | 4/1962 | France | 224/919 |

*Primary Examiner*—Charles E. Phillips
*Assistant Examiner*—Glenn T. Barrett

[57] ABSTRACT

A ball holder made of stretchable fabric with one or more dispensing openings 14 ) through which balls can be inserted and removed. The dimensions of the holder hold the balls snugly into place without them moving or coming out of the dispensing opening (14) prematurely. This holder can be attached to other items such as a bag or belt with a loop (24).

6 Claims, 2 Drawing Sheets

BALL HOLDER

BACKGROUND—FIELD OF INVENTION

This invention relates to a ball holder, particularly to devices that hold balls for games and sports with smaller balls such as golf, tennis, racquetball, ping-pong, and marbles.

BACKGROUND—DISCUSSION OF PRIOR ART

The sports industry is currently booming and there is a need for various accessories to help athletes, such as golfers, play better and enjoy their game. One such accessory is a ball holder which golfers and tennis players can use to conveniently hold and access balls while on the golf course or tennis course.

Heretofore, golf ball holders were mostly made of plastic or metal. They are convenient in that balls can be accessed quickly and with one hand. Most attach to a caddy cart, except for U.S. Pat. No. 4,840,322 to Hoyt (1989) that can be conveniently carried by the golfer. These prior art ball holders are complicated to make, however, and require expensive tooling, molds, and materials. Because of tooling costs, the cost of making these in a variety of shapes, sizes, and colors is prohibitive. Their hard edges can cut or damage golf bags and clothing. The ones made of plastic will break when they are empty and accidentally compressed by being stepped on or smashed by a falling golf bag. The ones made of metal generally have a metal spring which becomes inoperable when bent and they can rust. Some holders, such as Hoyt, use a cylindrical plastic tube which has a smaller diameter than the golf balls. The pressure from the smaller plastic or metal that holds the balls in place can scratch the golf balls and damage special imprinted logos on the balls.

There are also soft versions of the accessory and ball holders which do not scratch the golf balls and do not damage bags or clothing. One such device is U.S. Pat. No. 4,893,739 to Conner (1990), which uses a pocket to hold golf balls which needs to be opened and closed. This does not provide a quick release of golf balls, however, and is designed to be worn on the belt and is not easily attached to the golf bag or to a person not wearing a belt. It is also bulky because it is designed to hold many accessories in addition to golf balls. Another soft ball holder is U.S. Pat. No. 4,917,282 to Hufford (1990), which is made of a resilient material such as foam rubber and is designed to hold six balls. Its advantage over its prior art is that a plurality of balls can be seen at one time for golfers who want a different ball for every shot. Because of all the foam rubber, this holder is several times larger than the present invention and takes up much more space in the golfer's bag. In addition, the Hufford holder is not designed to be carried on the golfer's person. Furthermore, all of the above holders are limited in their ability to be manufactured them in a variety of colors, shapes, and designs, critical in the marketing of accessories in the fashionable golf industry.

It is the objective of this invention to provide an attractive and stylish game and sport ball holder that allows a quick release of the game ball without the balls being jarred loose during play, and that can be conveniently attached to sports bags and caddy carts as well as directly to the user. This invention will not damage golf bags, clothing, or balls since it is made of soft resilient material. This invention also does not take up much space; the preferred embodiment can be made to add less than two millimeter thickness to the volume of the balls. This invention is made of common materials which are available in a large variety of colors and patterns. Furthermore, this invention uses sizes of this material which are commonly discarded as scrap, thus making the invention very economical to manufacture. This invention also allows users with limited use of their hands or fingers to remove balls from the holder using another object such as a golf club. The invention has a major marketing and usage advantage over the prior art since the unique squeezing action used to remove the balls makes it fun and interesting to use.

OBJECTS AND ADVANTAGES

Accordingly, several objects and advantages of my invention are:

(a) to provide a holder that is a simpler and more unique solution to a problem solved in the past with much more complicated plastic or metal designs, thus making it easier to penetrate market compared to a device whose function is completely new to the market (b) to provide a holder which can be easily and inexpensively produced in a large variety of colors and shapes (highly desirable for sports like golf) without the manufacturing difficulties of the plastic and metal varieties, such as the necessity of making injection or casting molds making batches of colorants, cleaning out injection molds, purging extruders of old resin, painting metal parts, etc.

(c) to provide a holder that conserves resources by utilizing scrap pieces of fabric that would otherwise be disposed of (d) to provide a holder that dispenses balls faster and is easier to use than the complicated metal and plastic varieties that require several steps to use (e) to provide a holder that is interesting to touch and use and generates excitement when people use it or play with it (f) to provide a holder that doesn't have hard edges which can damage bags, clothing, or other material (g) to provide a holder that is almost impossible to break, easily repairable, and doesn't rust or tarnish like those made of metal (h) to provide a holder that protects balls from scratching (i) to provide a holder which allows balls to be removed with instruments other than the hand, such as a golf club Further objects and advantages are to provide a ball holder which can be used to hold balls for storage and while playing games or sports, which allows balls to be quickly and easily inserted and removed, and which can be attached to a sports bag, cart, or the user's clothing. Still further objects and advantages will become apparent from a consideration of the ensuing description and drawings.

Figure 1:
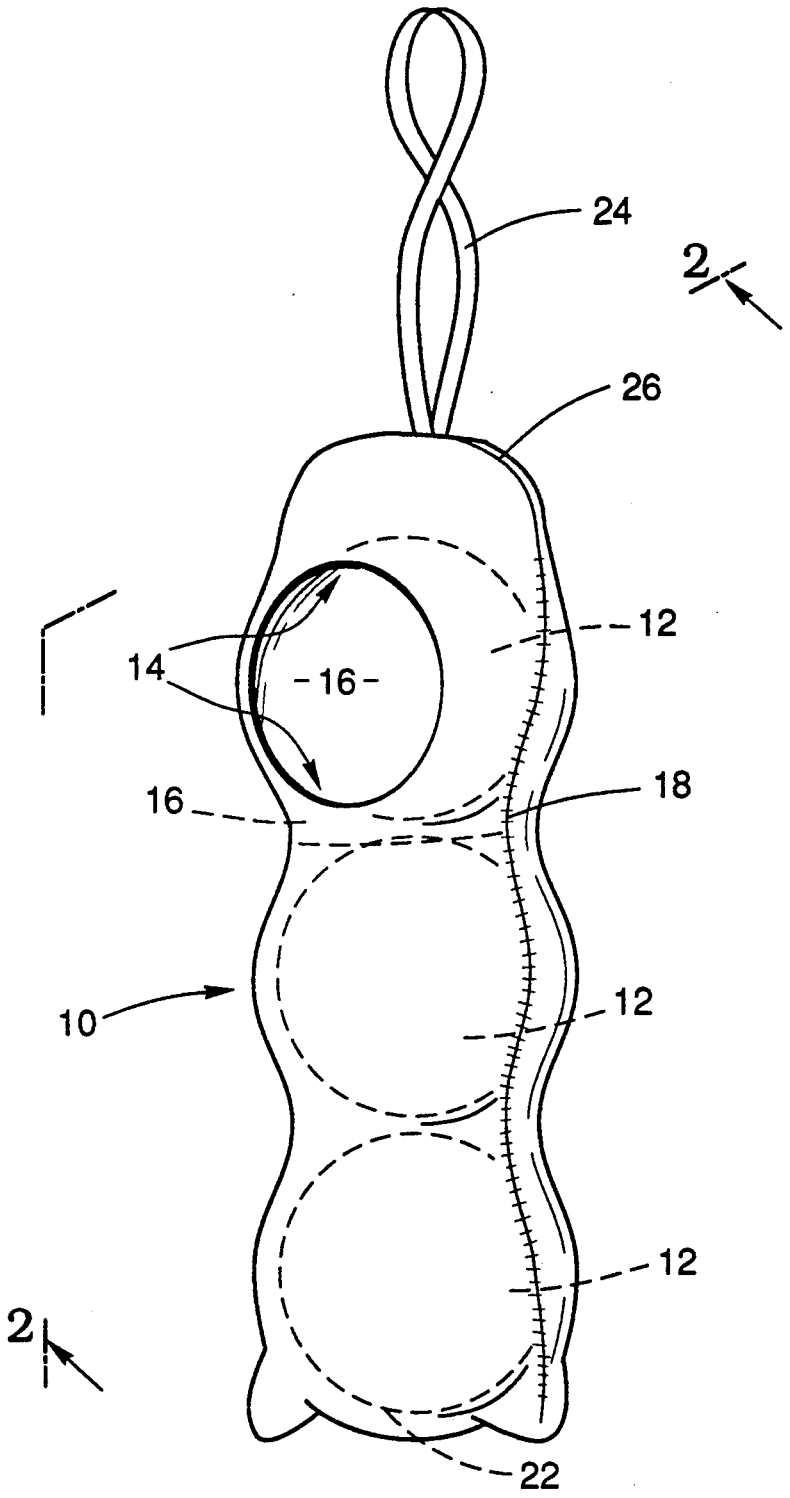
FIG. 1 is a perspective view of the ball holder of the present invention while full of three balls

| Reference Numerals in Drawings | |
|---|---|
| 10 | ball holding device |

-continued

| Reference Numerals in Drawings | |
|---|---|
| 12 | balls |
| 14 | dispensing opening |
| 16 | retaining flap |
| 18 | vertical side |
| 20 | top side |
| 22 | bottom side |
| 24 | loop |
| 26 | loop seam |

DESCRIPTION OF THE PREFERRED EMBODIMENT—FIGS. 1 AND 2

Figure 2:
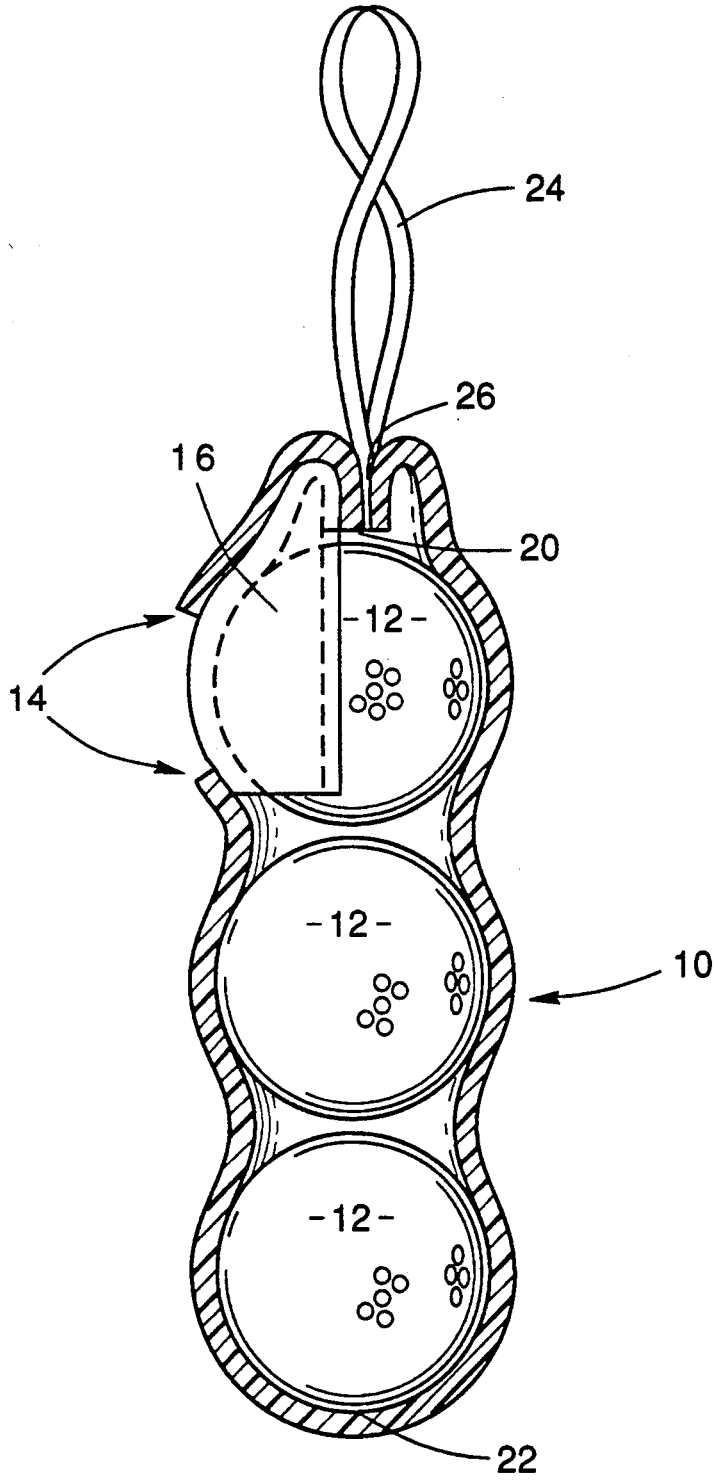
FIG. 2 is a cross section view of the ball holder illustrated in FIG. 1

As illustrated in FIG. 1 and further depicted in the cross-sectional view of FIG. 2, the ball holding device 10 of this invention comprises of two pieces of stretchable material such as a fabric-coated neoprene. One piece forms a hollow pouch which is the main part of device 10 and the other is used inside device 10 as a retaining flap 16. Balls 12 are held into place by the tension created by the stretching of the material as balls 12 are placed into device 10. The length and width of device 10 are determined by the size of balls 12 to be inserted. The width of device 10 must be wide enough to allow balls 12 to be moved within device 10, but narrow enough so that the fit is fairly snug and secure. The height of device 10 should be tall enough to accommodate three balls allowing the top ball to be just touching a top side 20 and the bottom ball to be just touching a bottom side 22. A dispensing opening 14 is positioned so that it is centered around the middle of top ball 12 in device 10. Dispensing opening 14 is round with a diameter of between 10 to 100 percent of the diameter of the ball enclosed in device 10. The diameter of dispensing opening 14 must be large enough for a ball to be easily inserted through dispensing opening 14 as it is stretched, but small enough to hold ball 12 in place once it is inside device 10. This diameter is dependent on the size and texture of the ball and the physical properties of the material used for device 10. Retaining flap 16 is attached inside device 10 to loop seam 26 extending down vertical side 18 just below dispensing opening 14.

To manufacture device 10, the material is cut and folded over at bottom side 22 and joined around vertical sides 18. A loop 24 and retaining flap 16 are joined into a loop seam 26 which may or may not be part of the seam made to connect vertical sides 18. The device has a flaccid shape until balls are inserted whereupon it takes the shape of these balls, as shown in FIG. 1.

Device 10 may be made from any suitable resilient material, but preferably is made from FABRIC LINED CLOSED CELL NEOPRENE sold by RUBATEX CORPORATION. This material can be cut and sewn as it is delivered, or scraps of this material remaining from the manufacture of other products can be used. Typically, the device as laid out in FIG. 1 will have dimensions in accordance with the following specifications, based on the diameter of a standard size golf ball: (1) a length ranging between 14 and 17 centimeters, (2) a width (prior to inserting balls) ranging between 5 and 7.5 centimeters, (3) a width (after inserting the ball) ranging between 4.5 and 6 centimeters, (4) dispensing opening 14 having a diameter ranging between 2 to 4 centimeters, (5) retaining flap 16 having a height ranging between 5 and 7.5 centimeters and width equal to the width of device 10, and (6) material thickness ranging between 1 and 6 millimeters.

In other embodiments of the invention, loop 24 is replaced by a hook, a hook and loop fastener such as velcro, buttons, clasp, snap, zipper, or other attaching device. In still other embodiments, there are loops at both ends of device 10 and device 10 is horizontal.

OPERATION OF INVENTION-FIG. 1

To use this device as depicted in FIG. 1, balls 12 are inserted through dispensing opening 14 past retaining flap 16, and pushed to the bottom of the device by either sticking a finger in the hole and pushing them down, or by squeezing them down through the outside in a manner similar to squeezing toothpaste out of a toothpaste tube. The last ball to be inserted goes directly in and is not pushed down. Retaining flap 16 can be pulled over the last ball to help hold it inside device 10.

To remove the top ball 12 from device 10, the user simply squeezes the outside of the top of device 10 on the side and a little bit behind of top ball 12. The ball 12 will then pop out. To remove the lower balls, they are moved to the top of device 10 by squeezing from the bottom, in a manner opposite of the way that they were inserted. Once they are at the uppermost position, they can be removed in the same manner as the first ball.

In another embodiment of the invention, there is a dispensing opening centered around each ball so that it does not have to be moved up and down device 10 in order to be inserted or removed. This embodiment may or may not include a retaining flap 16 for each hole.

To attach device 10 to a golf bag, belt loop, or other item as depicted in FIG. 1, device 10 must be empty. Loop 24 is placed through a ring on the bag or belt and then device 10 is pushed through loop above the ring. As device 10 is pulled through completely, loop 24 becomes securely attached to the ring on the bag or belt. In other embodiments of the invention, loop 24 is replaced by a hook, a hook and loop fastener such as Velcro, buttons, clasp, snap, zipper, or other attaching device that can be used to attach the device to the bag or belt.

In another embodiment of device 10 there are loops or other attaching devices at top side 20 and bottom side 22. In this embodiment, device 10 is horizontally strapped around a person's waist. This is particularly suited to holding tennis balls during play.

SUMMARY, RAMIFICATIONS, AND SCOPE

Accordingly, the reader will see that the game and sports ball holder provides an easy and convenient way to carry and store balls for games and sports. Furthermore, the ball holder has the additional advantages in that

- it provides a simple and unique solution to a problem for which prior attempts have all been relatively similar to each other and much more complicated
- it can be easily and inexpensively produced in a variety of shapes, colors, and patterns using scrap materials
- it doesn't damage clothing or items to which it is attached and it protects the balls from scratching
- it is extremely difficult, if not impossible, to break
- it is easy, quick, and fun to use While the above description contains many specificities, these should not be construed as limitations on the scope of the invention, but rather as an exemplification of one preferred embodiment thereof. Many other variations are possible. For example, the ball holder can have other shapes, such as triangular, square, spherical, pyramidal, and all other geometric shapes; the device can be designed to hold a smaller or larger number of balls; the device can be used and held at other angles besides vertical; the device can be used for other uses besides sports and games, such as holding ball bearings for machine operations; it can hold other shapes besides balls, such as dice shaped like cubes; and so forth.

Thus the scope of the invention should be determined by the appended claims and their legal equivalents, rather than by the examples given.

The above description presents the best mode contemplated of carrying out the present invention as depicted by the preferred embodiment disclosed. The combination of features illustrated by this embodiment provides its convenience of use and ease of manufacture. This invention is, however, susceptible to modifications and alternate constructions from the embodiment shown in the drawings and described above. Consequently, it is not the intention to limit it to the particular embodiment disclosed. On the contrary, the intention is to cover all modifications and alternate constructions found within the scope of the invention as generally expressed by the following claims.

I claim:

1. A device for holding at least one ball, said device comprising:

a hollow pouch formed from at least one sheet of elastic material, said hollow pouch having a closed top, a bottom, sides and an interior with inner dimension adapted to snugly accommodate said at least one ball;

at least one hole located in a side of said hollow pouch and having a diameter smaller than the diameter of said at least one ball wherein said elastic material permits said at least one hole to be expanded to receive said at least one ball therethrough and to reduce said at least one hole to the diameter less than the diameter of said at least one ball after said at least one ball has been inserted or removed therethrough, whereby said at least one ball can be pushed into and removed through said at least one hole, and stored and carried in said hollow pouch; and a flap assembly formed from a sheet of elastic material and located within said pouch interior adjacent said at least one hole for covering said at least one hole whereby said at least one ball is further prevented from passing through said at least one hole unless the user intentionally applies pressure to said at least one ball to force it through said at least one hole.

2. The device of claim 1, wherein said elastic material is neoprene.

3. The device of claim 2, further including an attaching means for releasably attaching said device to an object or person.

4. The device of claim 3 wherein at least one of said at least one hole is located directly adjacent to at least one ball when placed inside said hollow pouch.

5. The device of claim 1 wherein said hollow pouch is formed from a single sheet of elastic material.

6. The device of claim 5 wherein said pouch is adapted to receive golf balls.

* * * * *